United States Patent [19]

Althaus et al.

[11] Patent Number: 5,074,042

[45] Date of Patent: Dec. 24, 1991

[54] SHAVER HEAD WITH SWIVELLING BLADE BLOCK

[75] Inventors: Wolfgang Althaus, Wuppertal; Michael Schwarz, Herne, both of Fed. Rep. of Germany

[73] Assignee: Wilkinson Sword Gesellschaft mit beschränkter Haftung, Solingen, Fed. Rep. of Germany

[21] Appl. No.: 576,210

[22] Filed: Aug. 31, 1990

[30] Foreign Application Priority Data

Sep. 2, 1989 [DE] Fed. Rep. of Germany ... 8910490[U]

[51] Int. Cl.[5] ..... B26B 21/02

[52] U.S. Cl. ..... 30/50; 30/57

[58] Field of Search ..... 30/48, 49, 50, 57, 47, 30/77

[56] References Cited

U.S. PATENT DOCUMENTS

| | | | |
|---|---|---|---|
| 3,593,416 | 7/1971 | Edson | 30/57 |
| 3,955,277 | 5/1976 | Pomfret | 30/50 |
| 4,026,016 | 5/1977 | Nissen | 30/50 |
| 4,335,508 | 6/1982 | Francis et al. | 30/57 |
| 4,442,598 | 4/1984 | Jacobson | 30/47 |
| 4,461,079 | 7/1984 | Ciaffone et al. | 30/79 |
| 4,574,476 | 3/1986 | Ortiz | 30/47 |
| 4,693,003 | 9/1987 | Ferraro | 30/50 |
| 4,709,477 | 12/1987 | Ferraro | 30/50 |
| 4,715,120 | 12/1987 | McGready | 30/57 |
| 4,774,765 | 10/1988 | Ferraro | 30/50 |
| 4,777,722 | 10/1988 | Trotta | 30/77 |
| 4,813,131 | 3/1989 | Gruner | 30/50 |

FOREIGN PATENT DOCUMENTS

| | | |
|---|---|---|
| 45879 | 2/1982 | European Pat. Off. . |
| 2421662 | 12/1974 | Fed. Rep. of Germany . |
| 3019399 | 4/1981 | Fed. Rep. of Germany . |
| 3218411 | 12/1982 | Fed. Rep. of Germany . |

*Primary Examiner*—Frank T. Yost
*Assistant Examiner*—Hwei-Siu Payer
*Attorney, Agent, or Firm*—Robert W. Becker & Associates

[57] ABSTRACT

The invention relates to a shaver head for a wet shaver. The shaver head is arranged at the front end of a handle. A razor blade, in the form of a single or double razor blade, is mounted in the shaver head. The shaver head has a guide strip parallel to and in front of the cutting edges of the razor blades. To achieve a variation of the shaving angle and thus the cutting geometry in a technically simple fashion, the razor blades are arranged in a blade block which is swivelably mounted in relation to the remainder of the body of the shaver head. The blade block is able to swivel freely against a spring force about a swivelling axis parallel to the cutting edges of the blades.

10 Claims, 1 Drawing Sheet

SHAVER HEAD WITH SWIVELLING BLADE BLOCK

BACKGROUND OF THE INVENTION

1. Field of the Invention

The present invention relates to a shaver head for a wet shaver. The shaver head includes a razor blade and is arranged at the front end of a handle. The shaver head also includes a guide strip parallel to and in front of the cutting edge of the razor blade.

2. Description of Related Art

Conventional shaver heads for a wet shaver are arranged at the front end of a handle and include a single or double razor blade, which is covered by a cover cap. A guide strip is arranged parallel to and in front of the cutting edges of the razor blades.

In such a shaver head, the shaving geometry, and thus the shaving angle, are defined by the front guide strip, the rear cover cap and the cutting edges of the razor blades. However, these parts are fixed to one another, resulting in a completely predetermined shaving geometry and shaving angle, upon which the shaving properties depend. It is desirable, however, for the user to be able to vary the shaving geometry, and thus the shaving angle in accordance with his requirements.

SUMMARY OF THE INVENTION

It is an object of the present invention to develop a shaver head of a wet shaver type in such a way that a variation of the shaving angle and cutting geometry is possible in a technically simple fashion.

To achieve these objects the invention provides at least one razor blade arranged in a blade block which is mounted in relation to the remainder of the body of the shaver head. The blade block is capable of swivelling against a biasing force about a swivelling axis parallel to the cutting edge of the razor blade.

Accordingly, the shaving angle and thus the shaving geometry can be varied in a technically simple fashion. This is achieved according to the invention when, during shaving, the blade block carrying the razor blades is swivelled inwards in accordance with the pressure exerted by the user. In this way a simple variation of the shaving angle is facilitated. When the compressive force diminishes, the blade block with razor blade returns to its initial position. Consequently, the shaver head according to the present invention guarantees an overall improvement in shaving properties, since the entire blade block can be swivelled at a certain angle relative to the guide strip.

Preferably, the swivelling axis extends behind the cutting edge and the blade block is mounted so as to be able to swivel downwards into the body in the region between the swivelling axis and the guide strip. Consequently, the greater the pressure applied, the more the blade block is swiveled, and the smaller the shaving angle becomes.

Advantageously, the uppermost razor blade is covered by a cover cap through which the swivelling axis extends. In this way, the blade block is suspended to swing to a certain extent in the remainder of the body of the shaver head. Optimum conditions of leverage can thus be achieved.

In this arrangement, the swivelling axis preferably extends essentially in the region below the vertex of the cover cap.

In order to create in a structurally simple and inexpensive fashion a swivel bearing for the blade block, the bearing is preferably mounted swivelably in side walls of the body. The blade block preferably has lateral pins, which define the swivelling axis. The pins are swivelably mounted in corresponding recesses in the side walls of the body. Overall only two parts are required for the shaver head. The parts including a base body for housing the razor blade unit and a single-piece blade block in which the razor blades are embedded on plastic. The body is in the form of a single-piece plastic body and includes a guide strip. When the shaver head is assembled the blade block is inserted into the body, preferably from above. The two parts engage by virtue of the pins of the blade block, which snap into the corresponding recesses in the side walls of the body.

The blade block has lateral wings which include outer surfaces, which define guide surfaces for the swivelling movement of the blade block in conjunction with inner surfaces of the body. The inner surfaces of the body correspond to lateral wings of the side walls of the body. In this manner, a perfect swivelling movement of the blade block relative to the remainder of the body of the shaver head is ensured.

Stops are preferably provided between the blade block and the body to limit the movement of the blade block in predetermined, defined positions. Preferably, the stops are constructed between the lateral wings of the blade block and the side walls of the body.

To further improve shaving properties, the shaver head is preferably provided with a friction-reducing slide strip based, in particular, on water-soluble or water-insoluble polymers. The reduction of friction has the advantage that the shaving properties of the shaver head are improved.

The shaver head with a swivelable blade block according to the present invention can be used on any type of wet shaver. Thus, for example, the razor blades can be exchangeable. In a preferred embodiment, however, the shaver head is formed by a razor blade unit in which the razor blades are permanently embedded in the plastic blade block.

It is to be understood that both this general description and the following detailed description are exemplary and explanatory only and are not restrictive of the invention as claimed.

BRIEF DESCRIPTION OF THE DRAWINGS

The accompanying drawings which are incorporated in and constitute a part of the specification illustrate an embodiment of the invention, and together with the description serve to explain the objects, advantages and principles of the invention.

DESCRIPTION OF THE PREFERRED EMBODIMENT

Figure 1:
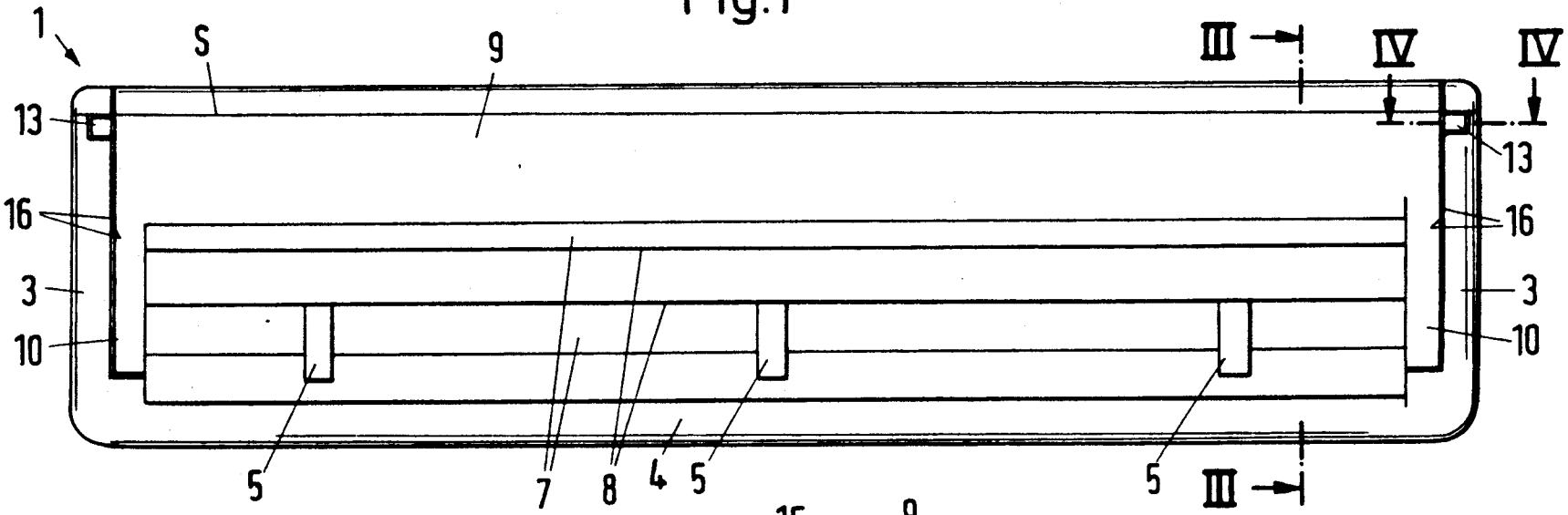
FIG. 1 is a top view of the razor blade unit of the present invention.

An embodiment of the present invention will be described with reference to the drawings.

A razor blade unit 1 consists of a body 2 made of plastic. Plastic body 2 has a side wall 3 at each of its two ends. Furthermore, a guide strip 4 is connected in one piece to the remaining part of body 2 via webs 5. Guide strip 4 extends in the longitudinal direction of the razor blade unit 1.

The razor blade unit 1 is provided to be arranged at the front end of a handle (not shown) of a wet shaver. Conventional fastening means (not shown) are provided on the body 2 of the razor blade unit 1 for fastening the shaver head to the handle.

Razor blade unit 1 has a blade block 6, also made of plastic. Embedded in blade block 6 are razor blades 7 in the form of a double razor blade, whose cutting edges 8 extend parallel to the guide strip 4. On the top side, the razor blades 7 are covered by a cover cap portion 9 of the blade block 6. Laterally, the blade block 6 respectively has a wing 10, which is received in a corresponding recess in the respective side wall 3 of the body 2.

Figure 4:
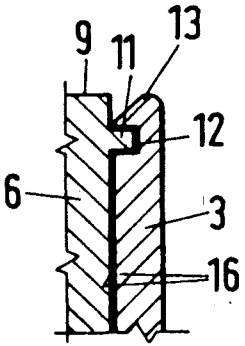
FIG. 4 is partial cutaway along the line IV—IV of FIG. 1.

The blade block 6 can be swivelled in conjunction with its embedded razor blades 7 inside the body 2 about a swivelling axis A, parallel to the cutting edges 8. In this arrangement, the swivelling axis A is located in the region of the vertex S of the cover cap 9. In order to facilitate the swivelling movement of the blade block 6 inside the body 2, the two wings 10 of the blade block 6 each have outwardly directed pins 11, which define the swivelling axis A. The insides surfaces of side wall 3 of body 2 each have a recess 12 to receive a pin 11. The top side of the side wall 3 of the body 2 respectively further has a bevel 13, as is to be seen, in particular, in the sectional representation in accordance with FIG. 4. During assembly blade block 6 with pins 11 can be placed from above onto the bevels 13. After the blade block 6 has been pressed down, the side walls 3 of the body 2 give way outwards, so that the pins 11 of the blade block 6 can be engaged in the associated recesses 12 in the body 2.

Figure 3:
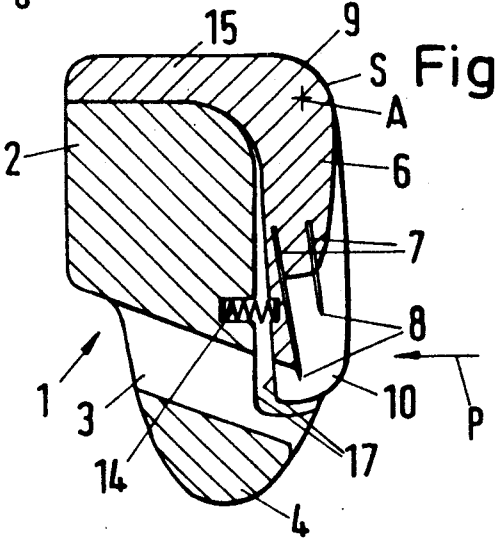
FIG. 3 is a partial cut away along the line III—III of FIG. 1.
Figure 2:
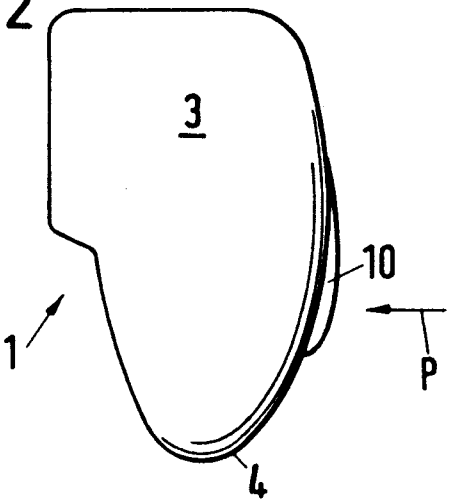
FIG. 2 is a side view of the razor blade unit.

As shown in FIG. 3, arranged between the body 2 and the blade block 6 is means for applying a spring force, spring 14. Spring 14 is in the form of a helical spring, which tends to rotate the blade block 6 counterclockwise, and thus to swivel the razor blades 7 outward into the position represented in FIG. 3. However, the fundamental position of FIG. 3 is limited by the bearing of the upper arm 15 of the blade block 6 on the top side of the body 2.

Spring 14 presses blade block 6 forward into the position represented in FIG. 3. As a result, there is a completely determined shaving geometry and shaving angle. During shaving, the razor blade unit 1 comes to bear on the skin of the user, the user naturally exerting a specific pressure on the razor blade unit 1. Consequently, the blade block 6 is swivelled with its embedded razor blades 7, in the direction of the arrow P against the force of the spring 14, the swivelling angle depending upon the size of the force exerted. Thus, the stronger the user presses the razor blade unit 1 onto the skin when shaving, the more the blade block 6 is swivelled inward, and the cutting geometry and thus the shaving angle vary correspondingly. In FIG. 3, the shaving angle is relatively large, while after blade block 6 is swivelled inwardly the angle is relatively small, so that overall it is possible to match the shaving angle to the particular shaving requirements.

In order to attain a perfect swivelling movement between the blade block 6 and the body 2, the outside surfaces of wings 10 of blade block 6 form together with the inside surfaces of the side walls 3 of body 2, guide surfaces 16. The surfaces being adjacent to one another in a parallel fashion. Furthermore, stops 17 are provided between body 2 and blade block 6. Stops 17 limit the swivelling angle of the blade block 6 with respect to the body 2, and are formed in the region of the side walls 3 and wings 10.

The razor blade unit 1 according to the present invention has the advantage that the entire blade block 6 can be swivelled by a certain angle relative to the guide strip 4. Thus, shaving geometry can be varied with the shaving angle, so that overall the shaving properties of the razor blade unit 1 are improved.

As illustrated in FIG. 3, the swivelling axis A is located in the region of the vertex S of the cover cap 9. This arrangement of the swivelling axis A is purely by way of example, and the axis can also assume a different position inside the body 2.

Other embodiments of the invention will be apparent to those skilled in the art from consideration of the specification and practice of the invention disclosed herein. It is intended that the specification be considered exemplary only, with a true scope and spirit of the invention being indicated by the following claims.

We claim:

1. A shaver head for a wet shaver, comprising:

at least one razor blade having a cutting edge;

a plastic body including a guide strip and a plastic blade block for supporting said at least one razor blade, said blade block being swivelably mounted in relation to the remainder of the body and including a cover cap portion above said at least one razor blade and a swivelling axis extending through the cover cap portion parallel to the cutting edge; and at least one spring disposed between the blade block and the remainder of the body in a region proximate to said at least one razor blade, for biasing the blade block relative to the remainder of the body and for permitting the blade block to swivel against the spring about the swivelling axis, to change the cutting geometry and shaving angle in response to the force exerted on the shaver by a user during shaving.

2. The shaver head of claim 1, wherein the blade block includes two outside surfaces generally converging at a vertex and the swivelling axis extends through the cover cap in a region proximate to the vertex.

3. The shaver head of claim 1, wherein the blade block includes two outside surfaces generally converging at a vertex and the swivelling axis extends through the cover cap essentially in a region below the vertex.

4. The shaver head of claim 1, wherein the body includes a pair of side walls and said blade block is mounted swivelably in the side walls of the body.

5. The shaver head of claim 4, wherein the blade block has a pair of lateral pins which form the swivelling axis, and each of the side walls include a recess therein, wherein the lateral pins are swivelably mounted within said recesses.

6. The shaver head of claim 4, wherein the side walls of the body each include an inner surface and the blade block includes a pair of lateral wings each having an outer surface, the outer surfaces forming together with the inner surfaces, guide surfaces for the swivelling movement.

7. The shaver head of claim 6, wherein a stop is constructed between each of the lateral wings of the blade block and the side walls of the body.

8. The shaver head of claim 1, wherein at least one stop is provided between the blade block and the body.

9. The shaver head of claim 1, wherein the guide strip comprises a friction reducing polymeric slide strip parallel to the cutting edge.

10. The shaver head of claim 1, wherein the at least one razor blade is permanently embedded in the blade block.

* * * * *